US005210780A

United States Patent [19]

Schweighofer et al.

[11] Patent Number: 5,210,780

[45] Date of Patent: May 11, 1993

[54] LOW RIPPLE X-RAY GENERATOR

[75] Inventors: Peter Schweighofer, Obermichelbach; Peter Tichy, Uttenreuth, both of Fed. Rep. of Germany

[73] Assignee: Siemens Aktiengesellschaft, Munich

[21] Appl. No.: 834,772

[22] Filed: Feb. 13, 1992

[30] Foreign Application Priority Data

Mar. 6, 1991 [DE] Fed. Rep. of Germany ..... 4107199

[51] Int. Cl.[5] ..... H05G 1/70

[52] U.S. Cl. ..... 378/105; 378/101; 378/103

[58] Field of Search ..... 378/101, 103, 104, 105, 378/106, 107, 109, 111

[56] References Cited

U.S. PATENT DOCUMENTS

| | | | |
|---|---|---|---|
| 4,317,039 | 2/1982 | Romandi | 378/105 |
| 4,350,891 | 9/1982 | Wuerflein | 378/105 |
| 4,720,844 | 1/1988 | Bougle | 378/101 |
| 5,003,452 | 3/1991 | Sireul et al. | 378/104 |

FOREIGN PATENT DOCUMENTS

| | | |
|---|---|---|
| 0405399 | 1/1991 | European Pat. Off. . |
| 429315 | 5/1991 | European Pat. Off. . |
| 1347225 | 2/1974 | United Kingdom . |

OTHER PUBLICATIONS

"The Generation of Recurring High-Voltage X-Ray Impulses" Clayton, Proc. IEEE 99, Part 1 (1952) pp. 206–213.

*Primary Examiner*—David P. Porta
*Assistant Examiner*—Kim-Kwok Chu
*Attorney, Agent, or Firm*—Hill, Steadman & Simpson

[57] ABSTRACT

A high-frequency x-ray generator having low high-voltage ripple at the x-ray tube with a small amount stored energy in the high-voltage circuit and low drive frequency has a series of secondary windings each connected to a high-voltage rectifier having a capacitor connected in parallel. These capacitors are connected in series for forming the x-ray tube voltage. Each secondary winding has a primary winding allocated to it. The primary windings in combination with delay capacitors form a delay line in which a traveling wave is generated by a primary voltage source.

4 Claims, 1 Drawing Sheet

LOW RIPPLE X-RAY GENERATOR

BACKGROUND OF THE INVENTION

1. Field of the Invention

The present invention is directed to a high-frequency x-ray generator, and in particular to an x-ray generator of the type having an x-ray tube fed by a high-frequency voltage supply.

2. Description of the Prior Art

The requirement of an optimally smooth high-voltage as a supply voltage for an x-ray tube is addressed in conventional x-ray generators by filtering with high-voltage capacitors whose capacitance is on the order of magnitude of a few nF. In addition to the high costs of these special capacitors, the large quantity of energy they store is an unsatisfactory factor since valuable time is lost for recharging the capacitors after a tube breakdown.

The capacitance of these capacitors must be reduced in order to reduce the stored energy. In order to nonetheless achieve a good smoothing, the inverter frequency of the inverter feeding the high-voltage transformer must be boosted, which can be economically accomplished only to a limited extent.

SUMMARY OF THE INVENTION

It is an object of the present invention to provide a high-frequency x-ray generator wherein the ripple of the high-voltage at the x-ray tube is low given a low energy stored in the high-voltage circuit and given a relatively low inverse rectifier frequency.

This object is achieved in accordance with the principles of the present invention in a high-frequency x-ray generator having a series of secondary windings, each secondary winding being connected to a high-voltage rectifier having a capacitor connected in parallel therewith. These capacitors are connected in series to form the x-ray tube voltage. Each secondary winding has a primary winding allocated to it, the primary windings forming a delay line in combination with delay capacitors, so that a traveling wave is generated in the delay chain by a primary voltage source connected to the delay line.

In the high-frequency x-ray generator of the invention, the secondary side is divided into individual sub-windings having separate rectification and filtering. The primary side is fashioned as a delay element, so that a traveling wave runs along the winding. The individual, secondary sub-windings are reached by this wave at different times and their associated capacitors are successively charged. Given a suitable dimensioning, at least one capacitor of a sub-winding is thus always charged. Despite a considerable ripple for each individual capacitor, the ripple of the aggregate voltage that forms the high-voltage for the x-ray tube is extremely low.

DESCRIPTION OF THE PREFERRED EMBODIMENTS

Figure 1:
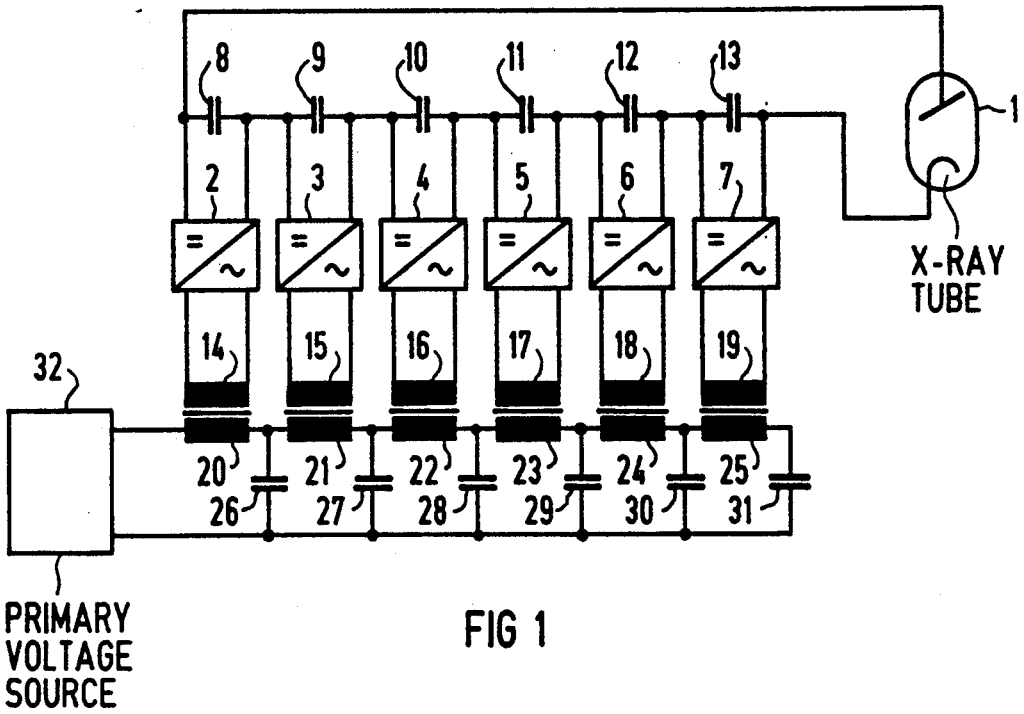
FIG. 1 is a schematic block diagram of a high-frequency x-ray generator constructed in accordance with the principles of the present invention.

FIG. 1 shows an x-ray tube 1 that is supplied with high-voltage by a series of high-voltage rectifiers 2 through 7. The high-voltage rectifiers 2 through 7 feed capacitors 8 through 13 respectively connected in parallel with the rectifiers 2 through 7. The capacitors 8 through 13 are connected in series with one another and form the high-voltage at the x-ray tube 1. The high-voltage rectifiers 2 through 7 are fed by secondary windings 14 through 19 of a high-voltage transformer which has primary windings 20 through 25 connected in series with one another. A respective primary winding 20 through 25 is allocated to each secondary winding 14 through 19.

Together with delay capacitors 26 through 31, the primary windings 20 through 25 form a delay line in which an inverter 32, that is supplied via a rectifier from the mains, generates a traveling wave.

Figure 2:
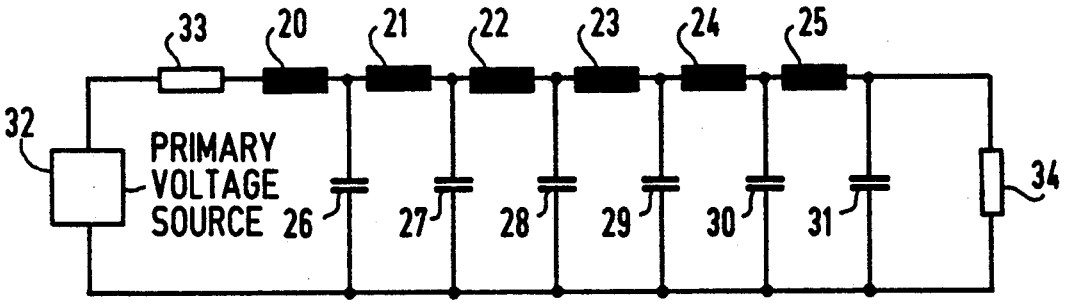
FIG. 2 is a circuit diagram for explaining the functioning of the high-frequency x-ray generator of FIG. 1.

FIG. 2 shows that the inverter 32, as a primary voltage source having the internal resistance 33, feeds the delay chain 20 through 31. The wave generated in this manner reaches the terminating resistor 34 after a certain delay and is more or less attenuated. The respective conductor sub-sections are reached at different times.

Only a traveling wave, i.e. not a standing wave, is desired. Usually for that purpose the resistances 33 and 34 must correspond to the characteristic impedance of the delay line in order to avoid reflections. A further possibility is to select the attenuation of the delay line so high that substantially no voltage is across the resistor 34, so that this resistor and the resistor 33 as well can be eliminated since there is no returning wave. This technique is utilized in the high-frequency x-ray generator of FIG. 1. The high attenuation ensues by supplying the energy to the secondary windings 14 through 19.

The amplitude of the wave decreases with increasing attenuation and distance from the feed rising therewith. This can be compensated by increasing the number of turns of the respective secondary windings. This means that the number of turns of the secondary windings 14 through 19 increases with increasing distance from the feed point.

Additionally, a substantially load-independent compensation of the amplitudes can be achieved by reducing the stray inductivity of the sub-transformers with increasing distance from the feed point.

The primary windings 20 through 25 can be expediently fashioned such that the delay capacitors 26 through 31 are formed by the winding capacitances themselves, so that additional capacitors at the primary side can be eliminated.

The magnetic coupling between the primary windings 20 through 25 and their corresponding secondary windings 14 through 19 must be optimally high but must be optimally low between windings not allocated to one another.

Although modifications and changes may be suggested by those skilled in the art, it is the intention of the inventors to embody within the patent warranted hereon all changes and modifications as reasonably and properly come within the scope of their contribution to the art.

We claim as our invention:

1. A high-frequency x-ray generator having an x-ray tube fed by a power supply including a high-voltage transformer, said high-voltage transformer comprising:

a plurality of secondary windings;

a plurality of high-voltage rectifiers respectively connected to said secondary windings;

a plurality of capacitors respectively connected in parallel with said high-voltage rectifiers, said capacitors being connected in series for forming a voltage, for said x-ray tube;

a plurality of primary windings respectively associated with said secondary windings; and a plurality of delay capacitors connected to said primary windings forming a delay line for a traveling wave generated by a primary voltage source connected across said capacitors.

2. A high-frequency x-ray generator as claimed in claim 1 wherein each of said primary windings has a winding capacitance, said winding capacitances forming said delay capacitors.

3. A high-frequency x-ray generator as claimed in claim 1 wherein said plurality of secondary windings has a feed point, and wherein said secondary windings have respective numbers of turns which increase with increasing distance of a secondary winding from said feed point.

4. A high-frequency x-ray generator as claimed in claim 3 wherein each secondary winding and the primary winding associated therewith have a stray inductance associated therewith, said stray inductances decreasing with increasing distance of associated primary and secondary windings from said feed point.

* * * * *